United States Patent [19]

Bulla

[11] Patent Number: 4,498,672

[45] Date of Patent: Feb. 12, 1985

[54] GOLF CLUB HEAD WITH FLEXURE FREQUENCY MATCHED WITH DISTORTION-RELAXATION FREQUENCY OF BALL

[76] Inventor: John G. Bulla, 2720 N. 10th St., Phoenix, Ariz. 85006

[21] Appl. No.: 542,479

[22] Filed: Oct. 17, 1983

Related U.S. Application Data

[63] Continuation of Ser. No. 365,294, Apr. 5, 1982, abandoned.

[51] Int. Cl.[3] ..... A63B 53/04

[52] U.S. Cl. ..... 273/169; 273/DIG. 12; 273/77 A

[58] Field of Search ..... 273/78, 169, DIG. 12, 273/170, 171, 172, 173

[56] References Cited

U.S. PATENT DOCUMENTS

| | | | |
|---|---|---|---|
| 1,318,325 | 10/1919 | Klin | 273/171 |
| 1,504,380 | 8/1924 | Reitenour | 273/169 X |
| 2,346,617 | 4/1944 | Schaffer | 273/169 X |
| 2,654,608 | 10/1953 | Liebers | 273/169 |
| 3,266,805 | 8/1966 | Bulla | 273/78 |
| 3,817,522 | 6/1974 | Simmons | 273/78 |
| 3,863,932 | 2/1975 | Lezatte | 273/169 |
| 3,989,248 | 11/1976 | Campav | 273/173 X |

FOREIGN PATENT DOCUMENTS

| | | | |
|---|---|---|---|
| 285238 | 1/1965 | Australia | 273/DIG. 12 |

*Primary Examiner*—George J. Marlo

*Attorney, Agent, or Firm*—Warren F. B. Lindsley

[57] ABSTRACT

Moldable golf club heads formed from a polypropylene plastic material encasing an elongated solid steel insert with a modulus of elasticity of approximately 30 million cycles per second and arranged with one end thereof extending one-eighth of an inch from the center of and substantially perpendicular to the striking face of the golf club head. The insert forms a part of the path for the shock wave produced when a ball having a resonant frequency of approximately 19 million cycles per second is struck by the head with the shock wave moving through the one-eighth of an inch of the plastic material, longitudinally through the insert to the head of the club and back the same path to point of impact whereby the density of the polypropylene and the insert being such that the recovery rate of flexure frequency of the head substantially equals the distortion frequency of the golf ball propelled from the club head.

5 Claims, 6 Drawing Figures

GOLF CLUB HEAD WITH FLEXURE FREQUENCY MATCHED WITH DISTORTION-RELAXATION FREQUENCY OF BALL

BACKGROUND OF THE INVENTION

This invention is a continuation of U.S. patent application, Ser. No. 365,294, filed Apr. 5, 1982 and entitled GOLF CLUB HEAD WITH FLEXURE FREQUENCY MATCHED WITH DISTORTION-RELAXATION FREQUENCY OF BALL, now abandoned.

This invention relates to molded golf club heads and particularly to a series of golf clubs in a correlated or matched set wherein all of the golf club heads have predetermined frequency characteristics.

In the past, golf clubs have been basically made with wood heads for the longer shots and iron heads for the intermediate to short shots. The basic material for iron heads is forged carbon steel or investment cast stainless steel alloy. In the forged head, the modulus of elasticity is such that its resonant frequency is approximately 29 million cycles per second; and in the stainless steel investment casting, the modulus of elasticity provides a resonant frequency of approximately 33 million cycles per second. Since a golf ball has a resonant frequency of approximately 19 million cycles per second, when struck with an iron head, the face of the club head kicks it off before the ball has a chance to reach full compression. It is harder for the average player to play with less lofted irons for this reason. Further, in order to get good results with an iron head, the ball must be struck precisely on the point of percussion of the club head. A miss-hit shot is more forgiving when it is hit by a club of large mass whose modulus is closer to that of a golf ball.

Most wood clubs today are made from persimmon or laminated wood blocks which have a much lower modulus of elasticity than that of a golf ball. Thus, the golf ball moves off the club face without the maximum force of the club impressed on it. The novelty of this invention is to match the club face resonant frequency of all clubs with the frequency of a golf ball. Another part of this invention is to match a complete set of golf clubs with the same sole plate, the same contoured back and the same shank. The only variance between golf clubs in a matched set will be that each club face will progressively have four degrees more loft as each club becomes one-half inch shorter in length and one-fourth ounce heavier in weight. A complete matching set of clubs is herein disclosed with each club face in phase with the force of the golf ball during contact.

The driver has the largest head with the lightest head weight of the set. In order to keep the right weight and to provide the right frequency on the face of the club, a cylinder of the right length and diameter is employed in the club head. It is milled and, in some instances, formed into a double cone configuration which gives the desired flexual force at the face of the club head, at the same time keeping the weight of the head down to a proper value.

Some efforts have been made to correlate club head designs, but without a full appreciation for all of the factors involved. Accordingly, a new set of golf clubs is provided which matches the club face resonant frequency with the resonant frequency of the golf ball.

DESCRIPTION OF THE PRIOR ART

U.S. Pat. No. 3,266,805 describes a golf club head made from a moldable plastic material wherein the shape of the head and the density of the material is such that when the head strikes a ball, the shock wave produced returns to the striking face. At that time, the ball begins to decompress and leave the face with the rate of recovery of the striking face matching that of the ball.

Although U.S. Pat. No. 3,266,805 teaches the desirability of having a golf club head flex at a frequency related to the distortion and relaxation frequency of the ball, it has been difficult to satisfactorily accomplish this function and to provide a matched set of clubs all employing this feature.

SUMMARY OF THE INVENTION

In accordance with the invention claimed, a new and improved set of matched golf clubs, each employing a novel golf club head, is provided wherein the golf club heads are made from a moldable plastic material, each encasing a metal insert which serves the dual purpose of weighting the club head and providing a path for the impact wave to follow through the club head in a predetermined manner.

It is, therefore, one object of this invention to provide a new and improved set of matched golf clubs.

Another object of this invention is to provide new and improved golf club heads.

A further object of this invention is to provide novel golf club heads, each employing a metallic insert arranged in a given manner which provides the dual purpose of not only weighting the golf club head, but also provides a predetermined path for the impact wave to travel through the head of the golf club.

A still further object of this invention is to provide new and improved golf club heads, the inserts of which are modified for the various golf club heads of a matched set to compensate for the difference in weights required of the various club heads in the matched set.

A still further object of this invention is to provide a new and improved moldable golf club head employing a metal insert which forms a path for the impact wave to return to the striking face at the time the ball begins to decompress and matches the decompression and relaxation features of the ball so as to maintain the ball in contact with the face of the club head a longer period of time than heretofore possible.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
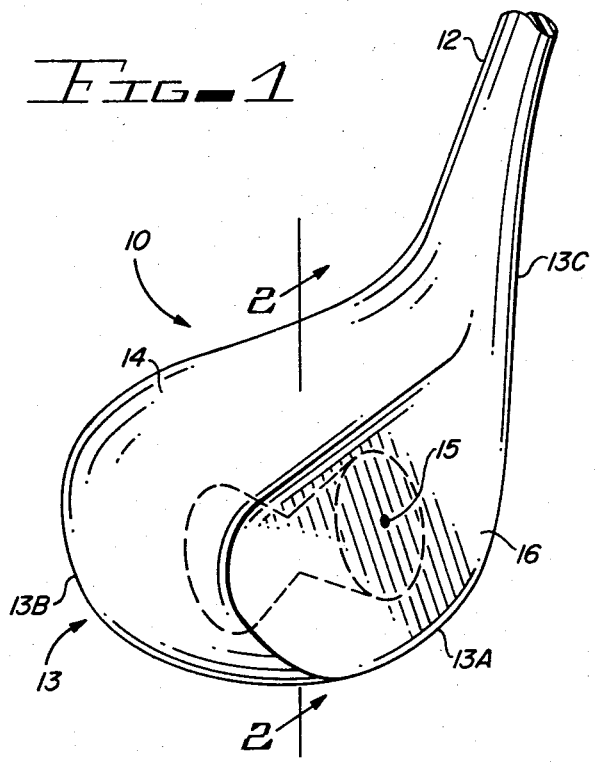
FIG. 1 is a partial perspective view of a golf club embodying the invention.

Although it is customary to have a complete set of clubs of the iron type from a No. 1 to a No. 11, 12 or 13, particularly among professional or serious golfers, it is quite common for other golfers to carry only Nos. 2 to 10 or 11, and for some to carry only a short set, usually consisting of Nos. 3, 5, 7, 9 and 11. Accordingly, to illustrate a set of coordinated golf clubs in accordance with the present invention, only a few golf clubs are shown in the drawing, it being understood that the clubs of more complete sets may also be provided with the novel features of the clubs illustrated.

Referring more particularly to the drawing by characters of reference, FIG. 1 discloses a golf club 10, the shaft of which is connected to a shank or hosel 12 of head 13. The head comprising a sole 13A, toe 13B and heel 13C, has a body portion 14 of a spherical section struck from a center 15 disposed on a striking face 16 which slopes at an angle of approximately ten degrees from the vertical for the golf club head shown.

Figure 2:
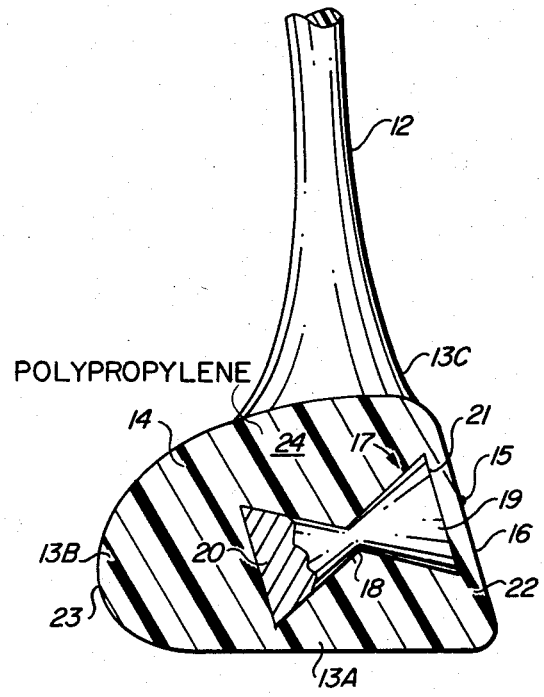
FIG. 2 is a cross-sectional view of FIG. 1 taken along the line 2—2.

As shown in FIGS. 1 and 2, the golf club head 13 is provided with a metallic member 17 mounted therein. Member 17 for the golf club head shown comprises a cylindrical configuration slimmed or necked down at its center 18 to form two substantially identical integral half sections 19 and 20. Section 19 is provided with an end face 21 which is juxtapositioned with, but spaced from, the striking face 16 of the golf club head 13. Member 17 is so arranged that its longitudinal axis is substantially perpendicular with the striking face of the club 13 and intersecting center 15.

The impact wave occurs in the golf club head when the ball is struck by the head approximately at the center of the striking face 16 and moves through the small amount of molded material 22 of the head, then longitudinally through member 17 to the spherical surface 23 of the body portion 14 of head 13, and back the same way to the point of impact. The density of the molded material and the metallic insert employed in the head is such that the recovery rate from the flexure frequency of the head substantially equals the distortion-relaxation frequency of the golf ball which is propelled from the face of the club.

This force will be effective at the face of the club and, due to the flexure frequency of the golf club head being matched with the distortion-relaxation frequency of the ball, the club head and ball will remain in contact longer than heretofore possible, thereby providing a maximum striking force to the ball at the time it separates from the club face.

It should be noted that to obtain the maximum loft and/or travel of the ball, the period of compression and expansion of the golf ball must be substantially equal to the period of time the shock wave takes to move into and through the body of the club head and to be substantially reflected back to the striking face of the golf club head. If the return wave through the golf club head is exactly in phase with the lift off wave of the golf ball, the maximum constructure reinforcement of the two wave motions occurs and the maximum projecting force is given to the ball.

The flexure mode frequency of the golf club head disclosed is designed to be substantially equal to the distortion-relaxation mode frequency of the ball.

The metallic insert or member 16 which may be, for example, formed of steel or a steel alloy is needed to substantially match the frequency of the hit golf ball and is placed or molded into the club head such that a face of it is positioned a predetermined distance, for example, one-eighth of an inch, from the striking face of the golf club head for predetermined golf clubs of a matched set.

The predetermined distance of the face of the insert from the face of the club depends upon the velocity of the elastic wave through the material of the club head. As the elastic wave velocity increases, said predetermined distance must increase in order to conform to the constructive reinforcement principles set forth above.

The moldable plastic material employed in the set of club heads may comprise a mixture of surlyn resin and kevlar fibers with the size and shape of the metallic insert or member 17 varied in length and shape to form the matched set of golf clubs, all embodying the flexure frequency necessary to match the distortion-relaxation frequency of the golf ball.

Although a mixture of surlyn resin and kevlar fibers has been disclosed as a suitable moldable plastic material, any suitable plastic material or compound thereof that has a satisfactory amount of elasticity and provides the proper impact strength when employed with the filler material may be used, such as polypropylene. The shaft of the golf club may be disposed in hosel 12 in a position to receive the plastic material 24 forming head 13 when it is forced into the mold so that the plastic material will fill the hollow shaft to a point adjacent to or slightly above the shank 12 of head 13.

In FIGS. 1 and 2, face 16 of the golf club is illustrated as being disposed on a slope of 10 degrees to the vertical. Other additional sloping faces are disposed at other angles, all arranged in a given progression well known in the art and usually involving changes of 3 degrees. With this arrangement, the last head of a series of thirteen club heads will have a face disposed at an angle of 45 degrees from the vertical.

Normally, as the slope of the head increases, the volume of the plastic material 24 decreases, and the lengths of the shafts decrease. In accordance with the teachings of this invention, the heads must be increased in weight so as to have all of the clubs of the set provide a like weight of swing to each of the clubs.

Figure 4:
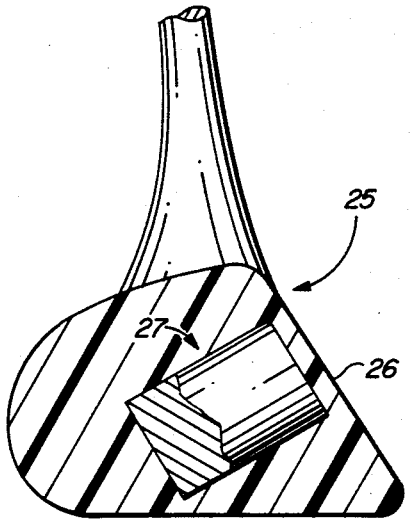
FIG. 4 is a partial perspective view of another golf club of the matched set embodying the novel features of the golf club head shown in FIG. 1.
Figure 5:
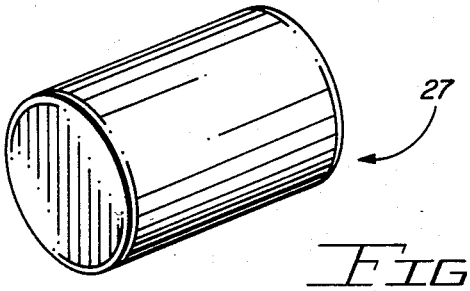
FIG. 5 is an enlarged perspective view of the insert shown in the golf club head shown in FIG. 4.
Figure 3:
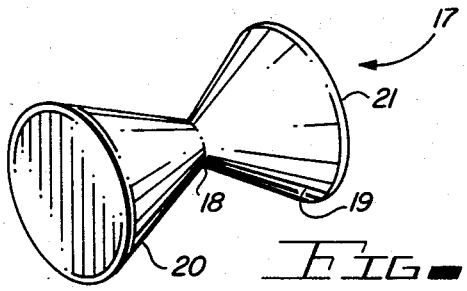
FIG. 3 is an enlarged perspective view of the insert shown in FIG. 1.

FIG. 4 discloses a modification of FIGS. 1 and 2 and illustrates a head 25 having a slope 26 of a different angular relationship. A metallic member 27 employed in this head, due to its geometrical configuration, has an increased amount of metal in it over that of metallic member 17 of FIGS. 1–3 to increase the weight of the head. Thus, the metallic members may be altered for each head to have a given weight so that the weight of each club remains the same, and the recovery rate thereof conforms to the rate of recovery of the ball, the amount of deflection of which decreases as the slope of the face of the club increases.

Figure 6:
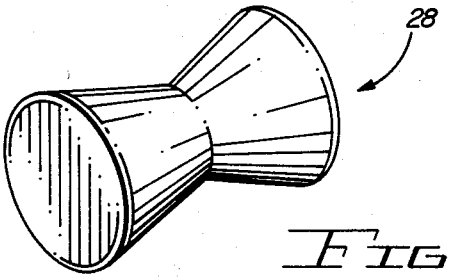
FIG. 6 is an enlarged perspective view of an insert for another golf club of the matched set.

It should be noted that a common cylindrical member is used for the insert of each club head of the matched set; however, the insert shape is modified between its lengths in a suitable manner to vary its weight to conform to the club in which it is used. One way of modifying the inserts is to neck down or taper the cylinder in the manner shown in FIG. 1 to reduce its weight. For purposes of illustration, FIG. 6 shows the dimensions of a metallic member 28 for another golf club head.

The following chart illlustrates the various clubs of a matched set and the main characteristics of each club, in accordance with the teachings of this invention.

| Club | Loft (°) | Lie (°) | Shaft Length (") | Head Weight (oz.) |
|---|---|---|---|---|
| 1 | 10 | 54 | 43 | 7.4 |
| 2 | 14 | 54 | 42¼ | 7.8 |
| 3 | 18 | 55 | 41¼ | 7.12 |
| 4 | 22 | 55 | 40¾ | 8.0 |
| 5 | 26 | 56 | 40 | 8.4 |
| 6 | 30 | 57 | 39¼ | 8.8 |
| 7 | 34 | 58 | 38½ | 8.12 |
| 8 | 38 | 59 | 37¾ | 9.0 |
| 9 | 42 | 60 | 37 | 9.4 |
| 10 | 46 | 61 | 36½ | 9.8 |
| 11 | 50 | 62 | 35¾ | 9.12 |
| 12 | 54 | 63 | 35 | 10.0 |
| 13 | 54 | 63 WEDGE | | |

Although but a few embodiments of the invention have been illustrated and described, it will be apparent to those skilled in the art that various changes and modifications may be made therein without departing from the spirit of the invention or from the scope of the appended claims.

What is claimed is:

1. A golf club head formed of a moldable plastic material comprising:

a body member formed of polypropylene having a sole, toe, heel and a planar striking face extending upwardly from said sole between said toe and heel and having a predetermined acute loft angle measured with respect to a plane passing through the axis of a shaft fastenable to said body member, said body member being formed into a portion of an arcuate configuration with a plane surface thereof forming said striking face, and an elongated solid steel insert with a modulus of elasticity of approximately 30 million cycles per second embedded in said body member and arranged so as to be completely surrounded by said plastic material with one end thereof spaced one-eighth of an inch from the center of and substantially perpendicular to said striking face, said insert forming at least a part of the path for the shock wave produced when a ball having a resonant frequency of approximately 19 million cycles per second is struck by the head at approximately the center of said striking face, which shock wave moves through said one-eighth of an inch of the polypropylene material forming said body member, then longitudinally through said steel insert and the remainder of the polypropylene body member to the arcuate configuration of said body member and back the same path to the point of impact of the ball with the striking surface, the density of the plastic material of said body member and said insert being such that the recovery rate of the flexure frequency of the head substantially equals the distortion-frequency of the golf ball when propelled from the face of the golf club head.

2. The golf club head set forth in claim 1 wherein:

said insert comprises a cylindrical configuration.

3. The golf club head set forth in claim 1 wherein:

said insert comprises a cylindrical configuration which is necked down between its ends.

4. The golf club head set forth in claim 3 wherein:

each half of said insert on each side of said necked down configuration is substantially identical.

5. The golf club head set forth in claim 3 wherein:

said insert comprises two integral substantially identical aligned portions.

* * * * *